US008412064B2

(12) United States Patent
Shibuya

(10) Patent No.: US 8,412,064 B2
(45) Date of Patent: Apr. 2, 2013

(54) IMAGE FORMING APPARATUS TO CONTROL PHOTOSENSITIVE MEMBER IRRADIATION

(75) Inventor: Kenichi Shibuya, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 336 days.

(21) Appl. No.: 12/875,595

(22) Filed: Sep. 3, 2010

(65) Prior Publication Data

US 2011/0058850 A1 Mar. 10, 2011

(30) Foreign Application Priority Data

Sep. 10, 2009 (JP) ..... 2009-065809

(51) Int. Cl.
*G03G 15/02* (2006.01)

(52) U.S. Cl. ..... 399/50; 399/45; 399/128; 399/174; 399/176

(58) Field of Classification Search ..... 399/45, 399/50, 128, 174, 176
See application file for complete search history.

(56) References Cited

U.S. PATENT DOCUMENTS

| | | | | |
|---|---|---|---|---|
| 5,634,179 | A | 5/1997 | Umeda | |
| 5,671,468 | A | 9/1997 | Yamamoto | |
| 2002/0102108 | A1* | 8/2002 | Adachi et al. | 399/50 |
| 2004/0223784 | A1* | 11/2004 | Nakahara et al. | |

FOREIGN PATENT DOCUMENTS

| | | | |
|---|---|---|---|
| JP | 5-341626 | A | 12/1993 |
| JP | 7-72711 | A | 3/1995 |
| JP | 7-114312 | A | 5/1995 |
| JP | 7-181775 | A | 7/1995 |
| JP | 9-22162 | A | 1/1997 |
| JP | 2001-296721 | A | 10/2001 |
| JP | 2005-258323 | A | 9/2005 |

* cited by examiner

*Primary Examiner* — Walter L Lindsay, Jr.
*Assistant Examiner* — Laura Roth
(74) *Attorney, Agent, or Firm* — Canon USA, Inc., IP Division

(57) ABSTRACT

An image forming apparatus includes a rotatable photosensitive member, a charging member, an applying device, an irradiation device, and a controller. The charging member contacts the photosensitive member to charge the photosensitive member. The applying device applies a direct-current voltage to the charging member. The irradiation device irradiates with light an upstream charging gap located upstream of a contact portion between the photosensitive member and the charging member in a rotation direction of the photosensitive member. The controller controls the irradiation device to irradiate with a first light amount when the photosensitive member rotates at a first speed, and to irradiate with a second light amount that is larger than the first light amount when the photosensitive member rotates at a second speed that is lower than the first speed.

2 Claims, 8 Drawing Sheets

IMAGE FORMING APPARATUS TO CONTROL PHOTOSENSITIVE MEMBER IRRADIATION

BACKGROUND OF THE INVENTION

1. Field of the Invention

The disclosed information relates to an electrophotographic image forming apparatus such as a copying machine, a printer, or a facsimile machine.

2. Background Art

Electrophotography is a printing process in which an image typically is formed with toner. First, variable areas of electrostatic charge transfers the toner to paper and then heat or pressure may fix the transferred toner to the paper. A conventional electrophotographic image forming apparatus may bring a roller or blade charging member into contact with a photosensitive member of the image forming apparatus to charge the photosensitive member.

Two methods are available to charge a photosensitive member by using a contact charging method. The first method is an "AC charging method" and the second is a "DC charging method." In the AC charging method, a superimposed voltage of direct-current voltage and alternating-current voltage is applied to a charging member to charge a photosensitive member. In the DC charging method, a direct-current voltage is applied to a charging member to charge a photosensitive member.

Due to the application of an alternating-current voltage, the AC charging method allows a more uniform charging of the surface of a photosensitive member than the DC charging method. However, the amount of discharge to the photosensitive member is larger in the AC charging method than the amount of discharge in the DC charging method. As a result, the surface of the photosensitive member is more easily scraped in the AC charging method. Thus, if a photosensitive member is charged using the AC charging method, the life of the photosensitive member will be shorter than when the photosensitive member is charged using the DC charging method.

The AC charging method has other disadvantages. For example, the AC charging method requires an AC power source, which means that the AC charging method has a greater initial cost and a higher running cost than that required for the DC charging method. In other words, the DC charging method is more cost effective than the AC charging method.

The DC charging method is not without its own issues. For example, the uniformity of surface potential of a photosensitive member (charging uniformity) is lower in the DC charging method than the charging uniformity in the AC charging method. Specifically, there has arisen a problem of stripe-shaped charging non-uniformity (charging lateral stripe) in the longitudinal direction (direction perpendicular to the circumferential direction) of an electrophotographic photosensitive member, which is caused by the non-uniform surface potential of the photosensitive member.

Japanese Patent Laid-Open No. 5-341626 discloses a configuration for suppressing formation of a charging lateral stripe that occurs when a photosensitive member is charged using the DC charging method. Specifically, among charging gaps produced by bringing a charging roller and a photosensitive drum into contact with each other, a charging gap located upstream in the rotation direction of the photosensitive member is irradiated with light (pre-nip exposure). Therefore, the charge of the photosensitive member is canceled in the charging gap located upstream, and the photosensitive member is charged in a charging gap located downstream in the rotation direction of the photosensitive member.

In turn, this suppresses the occurrence of a charging lateral stripe caused by separating discharge.

There has been an increasing demand for electrophotographic devices adapted to form images on a variety of media. A configuration for forming images on various media by changing the process speed depending on the type of the medium has been widely adopted. When a toner image is fixed onto a paper having a relatively high basis weight (hereinafter referred to as "thick paper"), a large amount of heat is required to guarantee fixing properties equivalent to when a toner image is fixed onto plain paper (paper having basis weight of approximately 50 to 100 mg/m$^2$). To account for the large amount of required heat when an image is to be formed on paper of high basis weight, the fixing speed of a fixing device typically is reduced to increase the heating time, and thus the amount of heat, given to the paper. Many image forming apparatuses further adopt a configuration in which the process speed of a photosensitive member also is reduced as, and in the same manner as, the fixing speed of the fixing device is reduced.

The above approaches have lead to further problems for an apparatus having a photosensitive member that moves at each process speed. For example, in such an apparatus, if a charging gap located upstream in the rotation direction of the photosensitive member is irradiated with constant light regardless of the process speed (rotational speed of the photosensitive member), then a charging lateral stripe occurs. Specifically, when an image is to be formed on plain paper, a charging lateral stripe occurs if the charging gap located upstream is exposed to light at an amount that is equal to the amount of light exposed to a charging gap located upstream when an image is to be formed on thick paper.

SUMMARY OF THE INVENTION

As noted, there has arisen a problem of stripe-shaped charging non-uniformity (charging lateral stripe) in the longitudinal direction (direction perpendicular to the circumferential direction) of an electrophotographic photosensitive member, which is caused by the non-uniform surface potential of the photosensitive member. Presumably, this is caused by the occurrence of separating discharge in a charging gap (fine gap) located downstream in the rotation direction of a photosensitive drum, between the photosensitive member that is charged in a charging gap located upstream in the rotation direction of the photosensitive drum and a charging roller. In addition, when an image is to be formed on plain paper, a charging lateral stripe occurs if the charging gap located upstream is exposed to light at an amount that is equal to the amount of light exposed to a charging gap located upstream when an image is to be formed on thick paper. Presumably, this is caused by the occurrence of separating discharge in a charging gap located downstream because if the process speed is low, the photosensitive member is sufficiently charged in the charging gap located upstream even when the charging gap located upstream is subjected to erasure with light.

In order to solve the above problems, the disclosed information describes an image forming apparatus including a rotatable photosensitive member, a charging member that charges the photosensitive member by being brought into contact with the photosensitive member, and an applying device to apply a direct-current voltage to the charging member. The image forming apparatus also includes an irradiation device for irradiating with light an upstream charging gap located upstream in a rotation direction of the photosensitive member. The image forming apparatus further includes a control device for controlling the irradiation device to irradiate with a first light amount when the photosensitive member rotates at a first speed, and to irradiate with a second light amount when the photosensitive member rotates at a second speed that is lower than the first speed.

Further features will become apparent from the following description with reference to the attached drawings.

DESCRIPTION OF THE EMBODIMENTS

A configuration for carrying out the disclosed information will be described hereinafter with respect to an example thereof. It is to be noted that the disclosed information is not to be limited to the following configuration. For example, any dimensions supplied are example dimensions and the scope of the subject matter of the claims are not limited to those dimensions.

Example 1

{Description of Overall Configuration of Image Forming Apparatus}

Figure 1A:
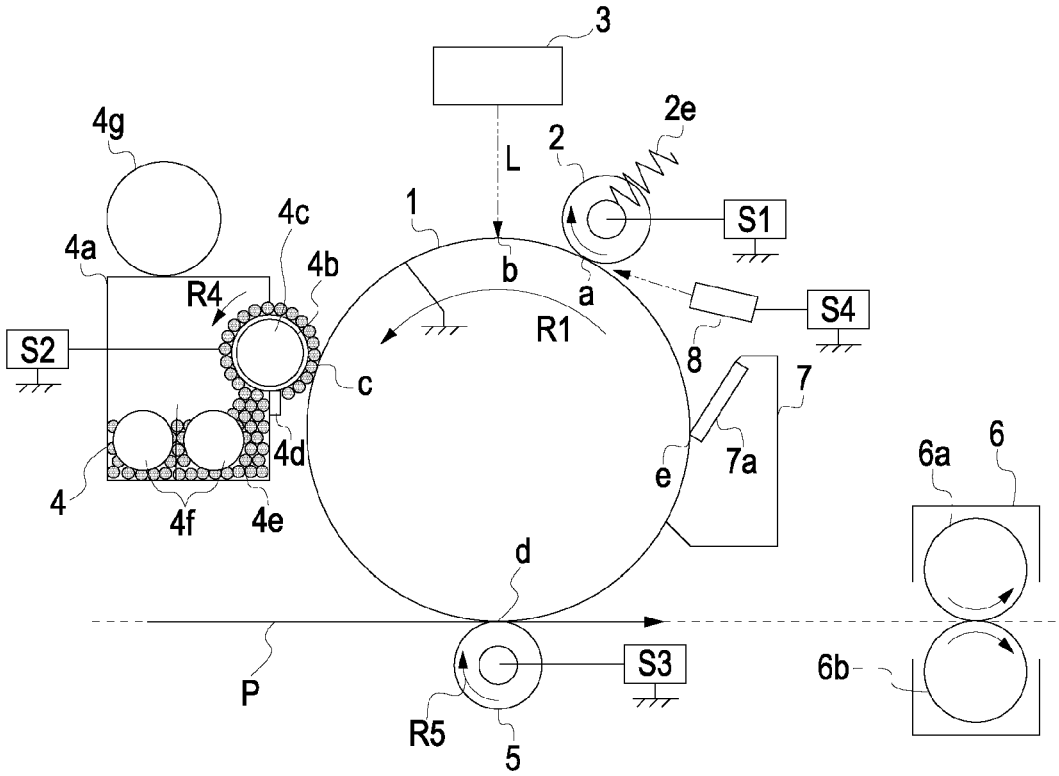
FIG. 1A is a diagram describing the schematic configuration of an image forming apparatus.
Figure 1B:
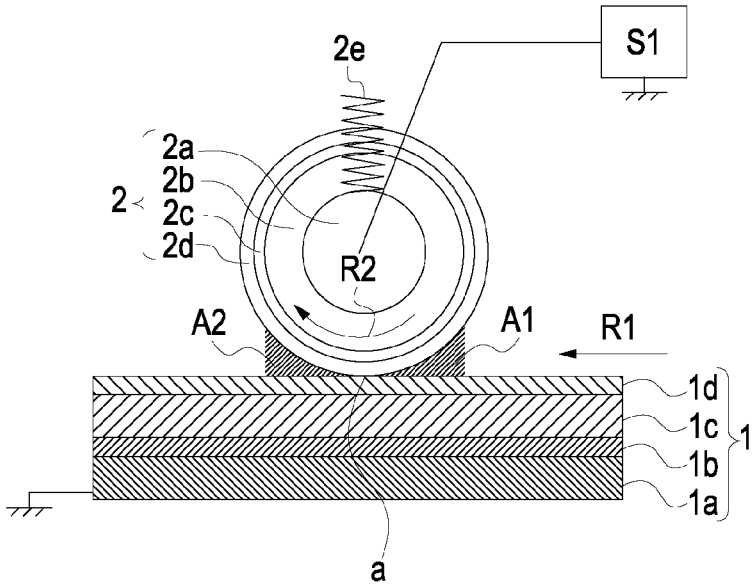
FIG. 1B is a diagram describing the layer configuration of a photoconductor drum and the layer configuration of a charging roller.

FIGS. 1A and 1B are schematic diagrams describing the overall configuration of an image forming apparatus. As illustrated in FIG. 1A, an image forming apparatus includes an electrophotographic image forming apparatus that uses a roller charging device to charge a photosensitive drum. More specifically, the image forming apparatus includes a laser beam printer capable of forming an image on paper up to A3 size. The image forming apparatus adopts a contact charging method in which a charging roller is brought into contact with the photosensitive drum and a reversal developing method in which a region where a toner image is to be formed is exposed to light.

In an example, a photoconductor drum 1 that is a drum-shaped photosensitive member is a negative chargeable organic photoconductor (OPC) with an outer diameter of 30 mm, and is caused to rotate by a driving force from a motor (not illustrated) serving as a driving device. Here, the photoconductor drum 1 is driven to rotate in the arrow direction (counterclockwise) at a peripheral speed (hereinafter referred to as a process speed) of 210 mm/s when an image is to be formed on plain paper, and at a peripheral speed of 105 mm/s when an image is to be formed on thick paper. As illustrated in FIG. 1B, the photoconductor drum 1 is configured by coating a surface of an aluminum cylinder (conductive drum base) 1*a* with three layers of an undercoating layer 1*b* for improving adhesiveness of upper layers while reducing optical interference, a photocharge generating layer 1*c*, and a charge transport layer 1*d* in order from the bottom.

In the image forming apparatus of FIG. 1A, a charging roller 2 serving as a charging member, which is in contact with the photoconductor drum 1, a developing device 4, a transfer roller 5, and a cleaning device 7 are arranged around the photoconductor drum 1 along the rotation direction (counterclockwise) thereof. Further, an exposure device 3 serving as an electrostatic image forming device is provided above the photoconductor drum 1 between the charging roller 2 and the developing device 4. A fixing device 6 is provided downstream in a transfer material conveying direction of a transfer portion d formed by the photoconductor drum 1 and the transfer roller 5. Each configuration will be described in detail hereinafter along with steps of the image forming apparatus.

{Charging Step}

The charging roller 2 that charges the photoconductor drum 1 is held in a rotatable manner at both ends of a core metal 2*a* by bearing members (not illustrated). A pressure spring 2*e* urges the charging roller 2 toward the center of the photoconductor drum 1 so that the charging roller 2 is pressed against the surface of the photoconductor drum 1 with a predetermined pressing force. The charging roller 2 rotates in accordance with the rotational driving of the photoconductor drum 1. The photoconductor drum 1 and the charging roller 2 are brought into contact with each other to form a contact portion. The gap between the photoconductor drum 1 and the charging roller 2 increases in the rotation direction of the photosensitive member from the contact portion. Here, the pressed portion (contact portion) between the photoconductor drum 1 and the charging roller 2 is referred to as a charging nip portion "a" (FIG. 1B). A fine gap located upstream the pressed portion in the rotation direction of the photoconductor drum 1 is referred to as an upstream-side charging gap A1. Similarly, a fine gap located downstream the pressed portion in the rotation direction of the photoconductor drum 1 is referred to as a downstream-side charging gap A2. The photoconductor drum 1 is charged in the upstream-side charging gap A1 and the downstream-side charging gap A2 with respect to the pressed portion. Discharging from the charging roller 2 to the photoconductor drum 1 performs the charging of the photoconductor drum 1. Thus, a voltage greater than or equal to a threshold voltage at which discharge starts is applied to the charging roller 2.

When a voltage greater than or equal to about −600 V is applied to the charging roller 2, the surface potential of the photosensitive member may start to increase. The surface potential of the photoconductor drum 1 may increase after the application of about −600 V while keeping substantially the linear relationship with applied voltages. For example, if −900 V is applied to the charging roller 2, the surface of the photoconductor drum 1 reaches −300 V. Further, if −1100 V is applied to the charging roller 2, the surface of the photoconductor drum 1 reaches −500 V. This threshold voltage (−600 V) is hereinafter referred to as a discharge start voltage (charging start voltage) Vth (V). That is, in an electrophotographic image forming process, it is necessary to apply both a charging start voltage Vth (V) and a dark potential voltage Vd (V) (e.g., Vd+Vth (V)) to the charging roller 2 to charge the potential on the surface of the photoconductor drum 1 to Vd (V) (dark potential). In other words, a voltage of Vd+Vth (V) is applied to the core metal 2*a* of the charging roller 2 by a power source S1, thus allowing the potential on the surface of the photoconductor drum 1 to reach Vd (V). In the image forming apparatus, the dark potential Vd may be set to −500 V when the photoconductor drum 1 is charged to form an image. Thus, during image formation, a direct-current voltage (hereinafter referred to as a DC bias) of −1100 V may be applied to the charging roller 2 from the direct-current power source S1.

The width of the charging gap in the photosensitive drum direction at which the charging roller charges the photoconductor drum 1 by discharging changes depending on the voltage applied to the charging roller. Under Paschen's law, breakdown voltage is described by the equation V=[a(pd)]/[ln(pd)+b], where V is the breakdown voltage in volts, p is the pressure, d is the gap distance, ln is the natural logarithm operation, and the constants a and b depend upon the composition of the surrounding gas. Thus, while a charging gap refers to a portion where the photoconductor drum is charged by the occurrence of discharging, a fine gap in which a discharge occurs when a voltage is applied changes in accordance with Paschen's law. Note that a portion where the photoconductor drum 1 is charged when a bias is applied to the charging roller 2 in the state where the rotation of the photoconductor drum 1 is stopped corresponds to a charging gap.

Subsequently, the charging roller 2 will be described in detail. The longitudinal length of the charging roller 2 may be 320 mm. As illustrated in FIG. 1B, the charging roller 2 has a three-layer configuration in which a lower layer 2*b*, an intermediate layer 2*c*, and a surface layer 2*d* are stacked in this order around the core metal (supporting member) 2*a*. The lower layer 2*b* may be a foamed sponge layer for reducing charging sound. Further, the surface layer 2*d* acts as a protective layer for preventing leakage of current even if the photoconductor drum 1 has a defect thereon such as a pinhole. The core metal 2*a* may be a stainless round bar with a diameter of 6 mm. Further, the lower layer 2*b* may be composed of foamed EPDM (ethylene propylene diene Monomer (M-class) rubber) with carbon dispersed therein with a thickness of 3.0 mm. Note that foamed EPDM having a specific gravity of 0.5 g/cm$^3$ and a volume resistance of 102 to 109 Ωcm may be used. The intermediate layer 2*c* may be composed of Nitrile based (NBR-based) rubber with carbon dispersed (a volume resistance of 102 to 105 Ωcm) with a thickness of 700 μm. Toresin is a special nylon-fiber binder based on N-methoxymethylated polyamide resin. The surface layer 2*d* may be formed of Toresin resin, which is a fluorinated compound, with a thickness of 10 μm. Note that Toresin resin with tin oxide and carbon dispersed therein and having a volume resistance of 107 to 1010 Ωcm may be used. Further, the surface roughness of the charging roller 2 (10-point average surface roughness Ra in JIS) may be 1.5 μm.

{Exposure Step}

The exposure device 3 serving as an electrostatic image forming device for forming an electrostatic image on the charged photoconductor drum 1 will be described. The exposure device 3 may be a laser beam scanner using a semiconductor laser. The exposure device 3 outputs a laser beam that may be modulated in accordance with an image signal input from a host processor such as an image reading device (not illustrated). The laser beam may be scanned at an exposure position b on the surface of the charged photoconductor drum 1, and an electrostatic image corresponding to the input image signal may be formed on the photoconductor drum 1 (on the photosensitive member).

{Developing Step}

Subsequently, a developing step will be described. The developing device 4 develops the electrostatic image formed on the photoconductor drum 1. A two-component developer is used, and an electrostatic image is developed using a magnetic brush. Since the image forming apparatus adopts the reversal developing method, attaching toner to an exposed portion (bright portion) of the surface of the photoconductor drum 1 develops the electrostatic image.

The configuration of the developing device 4 will be described in detail hereinafter. The developing device 4 includes a developing container 4*a*, and a rotatable non-magnetic developing sleeve 4*b* disposed at an opening of the developing container, which includes a fixed magnet roller 4*c*. To coat the sleeve 4*b* with a thin layer of developer, a regulating blade 4*d* regulates a developer 4*e* containing toner and carrier (magnetic particles) to obtain a certain thickness. On the developing sleeve 4*b* serving as a developer carrying member, the internal magnet causes the magnetic brush to be erected by the carrier, and the toner is conveyed to a developing portion c where the developing sleeve 4*b* faces the photoconductor drum 1. The developer 4*e* in the developing container 4*a* is a mixture of toner and magnetic carrier. The developer 4*e* is conveyed toward the developing sleeve 4*b* while being stirred uniformly by the rotation of two developer stirring members 4*f* (stirring screws).

In an example, the magnetic carrier has a resistance of about 1013 Ωcm and a particle diameter of about 40 μm. The toner is rubbed with the magnetic carrier and is therefore frictionally charged to the negative polarity. In addition, a density sensor (not illustrated) detects the toner density in the developing container 4*a*. Moreover, the toner is replenished into the developing container 4*a* from a toner hopper 4*g* based on detection information detected by the density sensor so that the toner density in the developing container can be made uniform.

The developing sleeve 4*b* is provided to face the photoconductor drum 1 in close proximity thereto while keeping the closest distance at the developing portion c from the photoconductor drum 1 at 300 μm. In addition, the developing sleeve 4*b* is driven to rotate in the direction opposite to the rotation direction (counterclockwise) of the photoconductor drum 1 at the developing portion c. Further, a predetermined developing bias is applied to the developing sleeve 4*b* from a power source S2. A developing bias in which a direct-current voltage (Vdc) and an alternating-current voltage (Vac) are superimposed may be applied to the developing sleeve 4*b*. Specifically, the frequency of the alternating-current voltage may be 8 kHz, the direct-current voltage may be −320 V, and the peak-to-peak voltage Vpp of the alternating-current voltage may be 1800 V.

{Transfer Step and Cleaning Step}

A toner image formed on the photoconductor drum 1 through the developing step is transferred onto a sheet in a transfer step. The transfer roller 5 abuts against the photoconductor drum 1 with a predetermined pressing force to form the transfer portion d. A transfer bias, such as a positive transfer bias having a polarity that is opposite to the normal charged polarity of the toner, i.e., negative polarity (in the example, +500 V), is applied to the transfer roller 5 from a power source S3. Therefore, the toner image on the surface of the photoconductor drum 1 is transferred onto a sheet conveyed to the transfer portion d. The cleaning device 7 cleans toner that is not transferred onto the sheet from the photoconductor drum 1. The cleaning device 7 includes a cleaning blade 7*a*.

Untransferred residual toner that is still attached to the photosensitive drum 1 is contacted with the cleaning blade 71 and is therefore removed. In FIG. 1A, reference numeral e denotes a photosensitive drum surface abutting portion of the cleaning blade 7*a*.

{Fixing Step}

Subsequently, a fixing step of fixing the toner image transferred onto the sheet in the transfer portion d will be described. The fixing device 6 that fixes a toner image onto a sheet includes a rotatable fixing roller 6*a* and a pressure roller 6*b*. In a fixing nip portion formed by the fixing roller 6*a* and the pressure roller 6*b*, the fixing device 6 fixes the toner image transferred onto the sheet by heating and pressing the toner image while conveying the sheet that is being held therebetween. A control circuit controls the rotational speeds of the fixing roller 6*a* and the pressure roller 6*b* in accordance with the material, thickness, basis weight, etc. of the sheet. Specifically, the fixing roller 6*a* and the pressure roller 6*b* rotate so that the process speed can reach 105 mm/s when an image is to be fixed onto thick paper (having basis weight of 101 to 200 g/m$^2$). Further, the fixing roller 6*a* and the pressure roller 6*b* rotate so that the process speed can reach 210 mm/s when an image is to be fixed onto plain paper (having basis weight 50 to 100 g/m$^2$).

{Regarding Operation Screen}

Figure 2A:
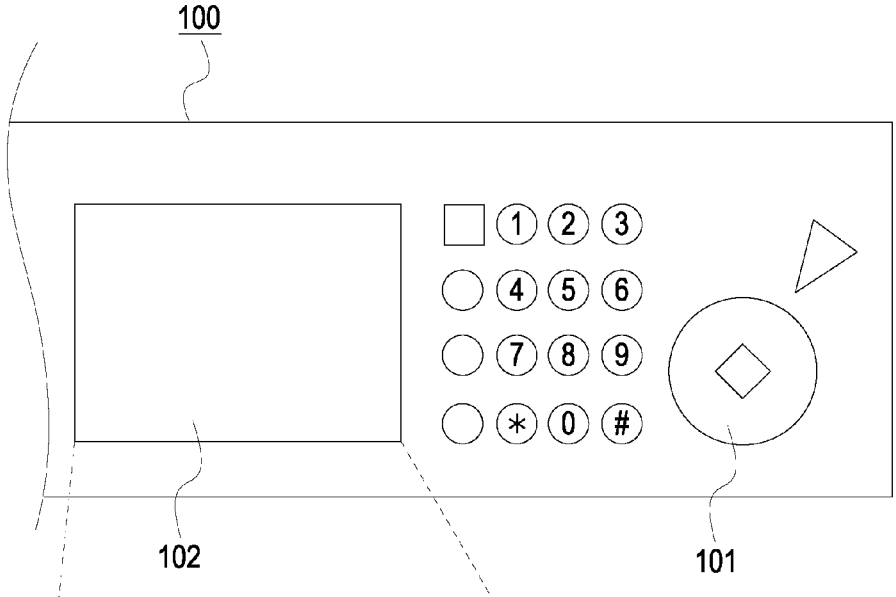
FIGS. 2A to 2C are schematic configuration diagrams illustrating an operation unit of the image forming apparatus.
Figure 2B:
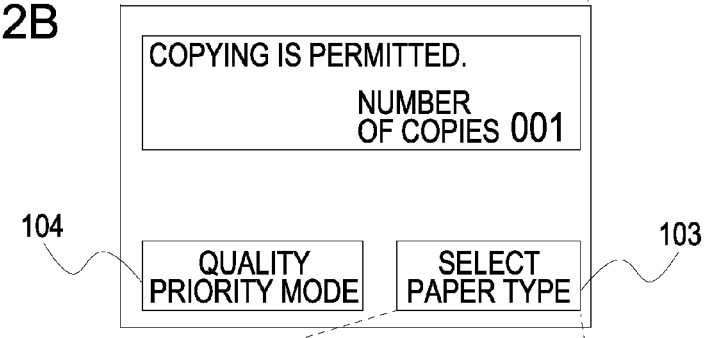
Figure 2C:
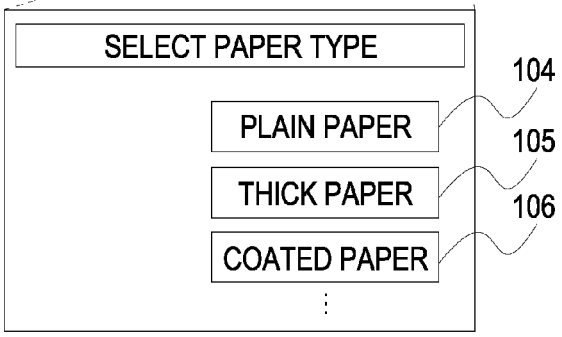

Subsequently, an operation panel unit in the image forming apparatus will be described. FIGS. 2A and 2B diagrams describing an operation panel. FIG. 2A is a diagram describing the outer appearance of an operation panel 100. The operation panel 100 includes a start button 101 for allowing the image forming apparatus to execute image formation based on set information. The operation panel 100 further includes a touch-panel display 102. A screen as illustrated in FIG. 2B is displayed on the display 102. A user can select a button displayed on the display 102 to perform various settings for image formation. In particular, the setting of the type of a sheet on which an image is to be formed and a quality priority mode will be described in detail. In FIG. 2B, reference numeral 103 denotes a button for setting the type of a sheet on which an image is to be formed. When reference numeral 103 is selected, a screen in FIG. 2C is displayed on the display 102. In FIG. 2C, a list of sheets available for image formation is displayed. A user can select one of plain paper 104, thick paper 105, coated paper, and the like in accordance with the type of the sheet to be used for image formation.

As described above, when the plain paper 104 is selected, the process speed is set to 210 mm/s. Further, when the thick paper 105 is selected, the process speed is set to 105 mm/s. Coated paper is a glossy sheet whose surface smoothness is improved by coating the surface of the sheet with a transparent resin. When an image is to be formed on coated paper, as with thick paper, the process speed also is set to 105 mm/s. The type of the sheet may not necessarily be set by a user but may be determined using a sensor or the like. In FIG. 2B, reference numeral 104 denotes a button for specifying a high-quality mode. With the use of this button, when an image is to be formed on plain paper, the process speed also is changed to 105 mm/s. The reduction of the process speed allows an electrostatic image having a higher resolution than that at a high process speed to be formed on the photoconductor drum 1.

When the start button 101 is pressed after the paper type, mode, etc. are set, the image forming apparatus forms an image in accordance with the set conditions. A printing instruction also may be input from an external terminal such as a PC.

{Regarding Pre-Nip Exposure Device}

Figure 3:
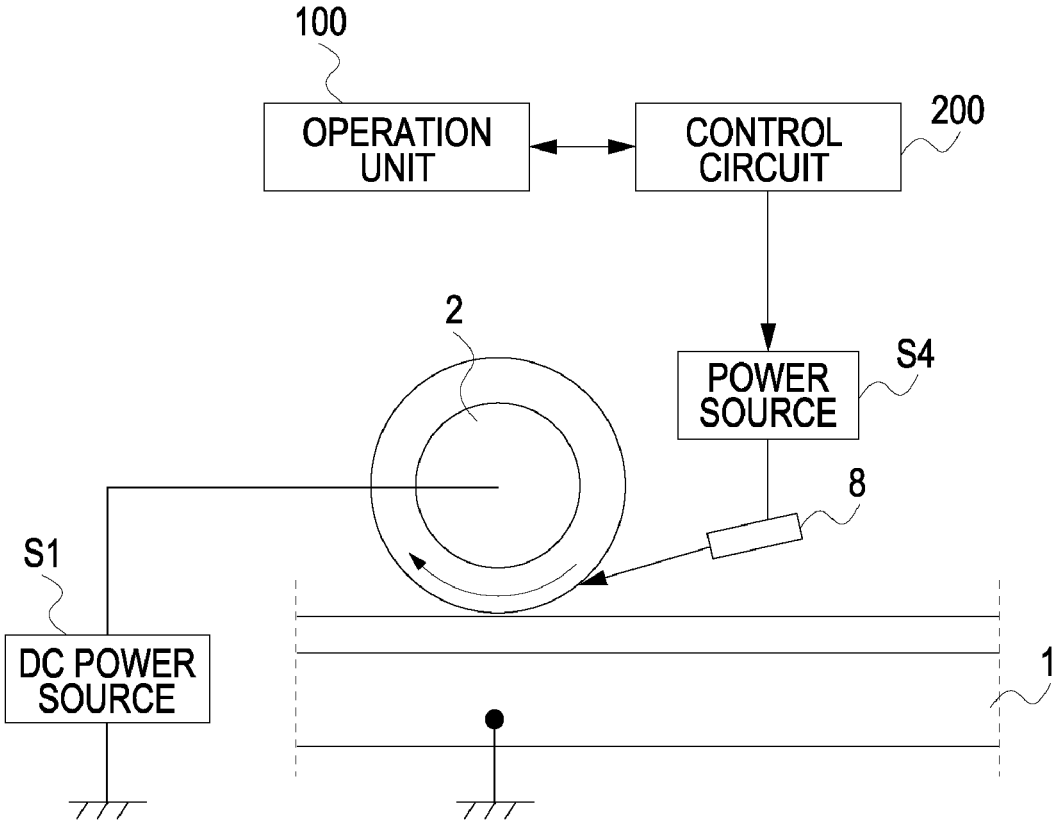
FIG. 3 is a block diagram of the image forming apparatus.

A pre-nip exposure device serving as an irradiation device for radiating light in order to suppress formation of a charging lateral stripe will be described hereinafter. FIG. 3 is a diagram describing a pre-nip exposure device that exposes a charging gap to light. Applying a direct-current voltage from the power source S1 to the charging roller 2 charges the photoconductor drum 1. Further, a power source S4 supplies power to a pre-nip exposure device 8 in accordance with the control of a control circuit 200. The pre-nip exposure device 8 radiates light to an upstream-side charging gap in the rotation direction of the photoconductor drum 1. More specifically, the pre-nip exposure device 8 exposes the upstream-side charging gap in the rotation direction of the photoconductor drum 1 to light from a nip portion between the photoconductor drum 1 and the charging roller 2, and an image forming region is erased in the longitudinal direction of the photoconductor drum 1.

An LED (Light Emitting Diode) having a peak wavelength of 660 (±10) nm at a room temperature (20° C.) may be used as the pre-nip exposure device 8. The wavelength of emitted light changes depending on the temperature of the material and the applied current. An LED having a forward drop voltage of 1.4 V, a maximum rated output of 3 mW, a maximum operating current of 95 mA, a maximum output of 2.1 mW, and a luminous efficiency of 39 lm/W may be used. A multiple number of such LEDs are arranged side-by-side, and an LED driver applies a PWM (Pulse Width Modulated) voltage to the LEDs to allow control of the light amount of the pre-nip exposure device. Note that the upstream-side charging gap refers to a small region where discharge is performed between the charging roller 2 and the photoconductor drum 1. The upstream-side charging gap A1 may be a region that is located 1 mm away upstream in the rotation direction of the photoconductor drum 1 from the nip portion between the photoconductor drum 1 and the charging roller 2. Likewise, the downstream-side charging gap A2 may be a region that is located 1 mm away downstream in the rotation direction of the photoconductor drum 1 from the nip portion between the photoconductor drum 1 and the charging roller 2.

The control circuit 200 serving as a control device includes a central processing unit (CPU), a random-access memory (RA)M, etc., and controls individual units of the image forming apparatus in accordance with an image forming signal input from the operation panel 100 serving as an operation unit or an external terminal such as a personal computer (PC). For example, the control circuit 200 obtains information or the like about a sheet specified using the operation panel 100, and determines the process speed accordingly. Further, the control circuit 200 controls the image forming condition of each image forming unit in accordance with the process speed.

Specifically, by way of example, the control circuit 200 may be capable of controlling power to be supplied to the pre-nip exposure device 8 from the power source S4. Light exposure may be referred to as luminous flux time per surface area–lux second [lx·s] or lumen second per square meter [lm·s/m$^2$], where imperial units are based on the US statute foot=0.3048 meters. In accordance with the power supplied from the power source S4 serving as a feeding device, the pre-nip exposure device 8 can output light of 0 to 15 lx·s per unit time. Note that the light amount may be measured using an illuminometer that conforms to general class AA of JIS C 1609-1 (revised 2006). The illuminometer measures the light amount in a visible light region (420 to 700 nm). Thus, for example, a photodiode may be used to detect a change in the light amount in a region other than the visible light region. In order to detect a change in the light amount in the wavelength at which the electric charge on the surface of the photosensitive member can be removed, preferably, a photodiode detects light transmitted through an optical filter that cuts the wavelength to which the photosensitive member is less sensitive.

{Regarding Mechanism of Occurrence of Charging Lateral Stripe Caused in Accordance with Changing of Process Speed}

Figure 8A:
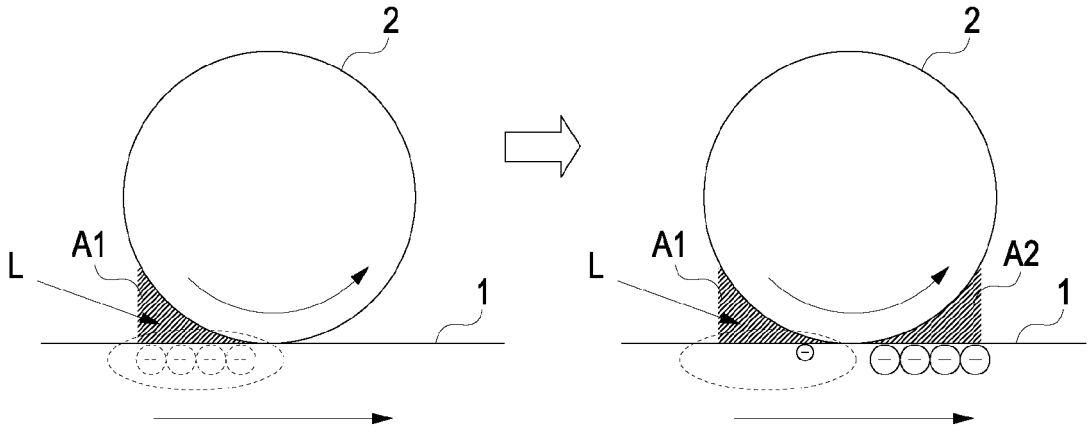
FIGS. 8A and 8B are diagrams describing the pre-nip exposure and the deviation of discharge caused by changing of the process speed.
Figure 8B:
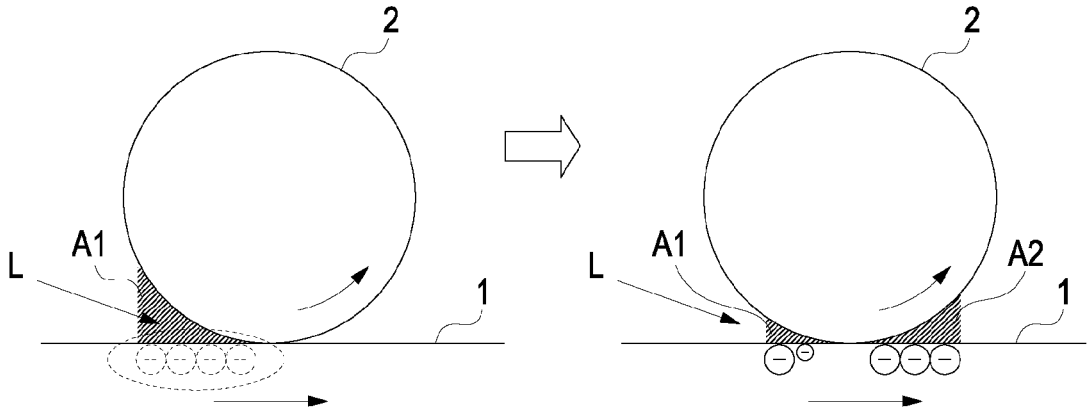

The case where the light amount of pre-nip exposure is made constant regardless of the process speed will be described hereinafter. FIGS. 8A and 8B are schematic diagrams describing a separating discharge phenomenon that occurs in the photoconductor drum 1 when the upstream-side charging gap in the rotation direction of the photoconductor drum 1 is exposed to light with a constant light amount in order to suppress formation of a charging lateral stripe. FIG. 8A is a schematic diagram of the upstream-side charging gap exposed to light when the process speed is 210 mm/s. Further, FIG. 8B is a schematic diagram of the upstream-side charging gap exposed to light with a light amount (7 lx·s), which is the same as that when the process speed is 210 mm/s, when the process speed is 105 mm/s.

First, the case where pre-gap exposure is not performed will be described. The charging roller 2 rotates forward relative to the photoconductor drum 1 that is rotating, and the photoconductor drum 1 is charged. In the upstream-side charging gap A1, when the potential difference between the photoconductor drum 1 and the charging roller 2 exceeds a discharge start threshold (based on Paschen's law), discharge is performed, and the photoconductor drum 1 is charged to the charging potential (Vd). However, if the resistance of a portion of the charging roller 2 is high or a portion of the photoconductor drum 1 is thick, uniform charging may not be completed in the upstream-side charging gap A1. In this case, minute discharge occurs in the downstream-side charging gap A2, resulting in the occurrence of charging lateral stripe. Thus, as illustrated in FIG. 8A, the upstream-side charging gap A1 is exposed to light to charge the photosensitive member at the downstream-side charging gap to suppress the occurrence of a charging lateral stripe. As illustrated in FIG. 8A, a laser beam L produced by the pre-nip exposure device 8 subjects the charged photoconductor drum 1 to erasure in the upstream-side charging gap A1. Thus, the photoconductor drum 1 is charged at the downstream-side charging gap A2. Here, minute discharge is less likely to occur in the downstream-side charging gap A2, and the formation of a charging lateral stripe can be suppressed.

Subsequently, the case where erasure is performed at the upstream-side charging gap A1 with an amount of light, which is similar to that when the process speed is 210 mm/s, when the process speed is 105 mm/s will be described. Even when the upstream-side charging gap A1 is exposed to light with a similar light amount, the photoconductor drum 1 is sufficiently charged at the upstream-side charging gap A1. That is, since the photoconductor drum 1 is charged at the upstream-side charging gap A1, the minute discharging that occurs in the downstream-side charging gap A2 cannot be sufficiently suppressed. In other words, when an image is to be formed on thick paper, if pre-nip exposure is performed with the same light amount as that in the case of plain paper, output printed matter containing an image defect caused by a charging lateral stripe is observed. Therefore, the image forming apparatus performs control to adjust the light amount of the pre-nip exposure device in accordance with the process speed.

{Regarding Process Speed and Amount of Pre-Nip Exposure}

The control circuit 200 changes the process speed based on the information or the like about the sheet set using the operation unit 100. As described above, if the upstream-side charging gap is exposed to light with a constant light amount regardless of the process speed, a charging lateral stripe is produced. Thus, the amount of light radiated to the charging gap is changed for each process speed, and an image defect caused by a charging lateral stripe that occurs in the current output printed matter is evaluated.

Table 1 is a table of evaluations for printed matter output with the amount of exposure changed when the process speeds are 210 mm/s (first speed) and 105 mm/s (second speed). A charging lateral stripe appears in a striped pattern in the direction parallel to the charging roller 2, and noticeably appears when a halftone image is formed. Thus, printed matter in which a halftone (125 out of 255 grayscale levels) image is formed over an entire sheet is used.

TABLE 1

| — | Amount of exposure (lx · s) | | | | | |
|---|---|---|---|---|---|---|
| Process speed | 5 | 7 | 9 | 11 | 13 | 15 |
| 105 (mm/s) | X | X | X | Δ | ○ | ⊙ |
| 210 (mm/s) | ○ | ⊙ | ⊙ | ⊙ | ⊙ | ⊙ |

In Table 1, ⊙ is marked when the image on the output printed matter is good, ○ is marked when the image is fair, Δ is marked when density variation occurs, and x is marked when density variation or non-uniformity of density occurs. As can be seen from Table 1, the lower the process speed, the more the need for suppressing formation of a charging lateral stripe by increasing the amount of pre-nip exposure.

{Regarding Amount of Pre-Nip Exposure and Amount of Scraping of Photoconductor Drum 1}

Figure 4A:
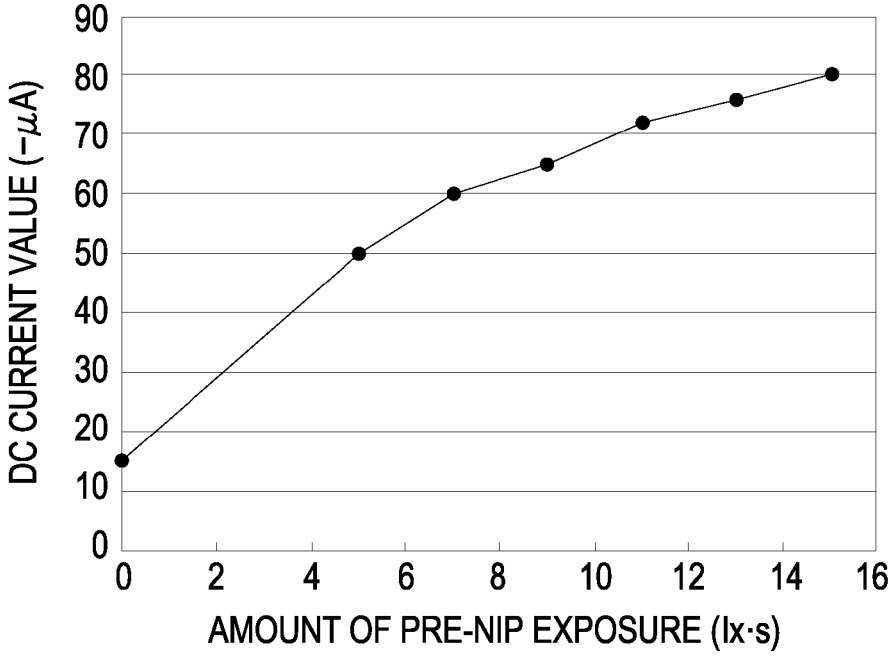
FIG. 4A is a graph illustrating the relationship between the amount of pre-nip exposure and the value of current flowing between the charging roller and the photoconductor drum in the image forming apparatus.
Figure 4B:
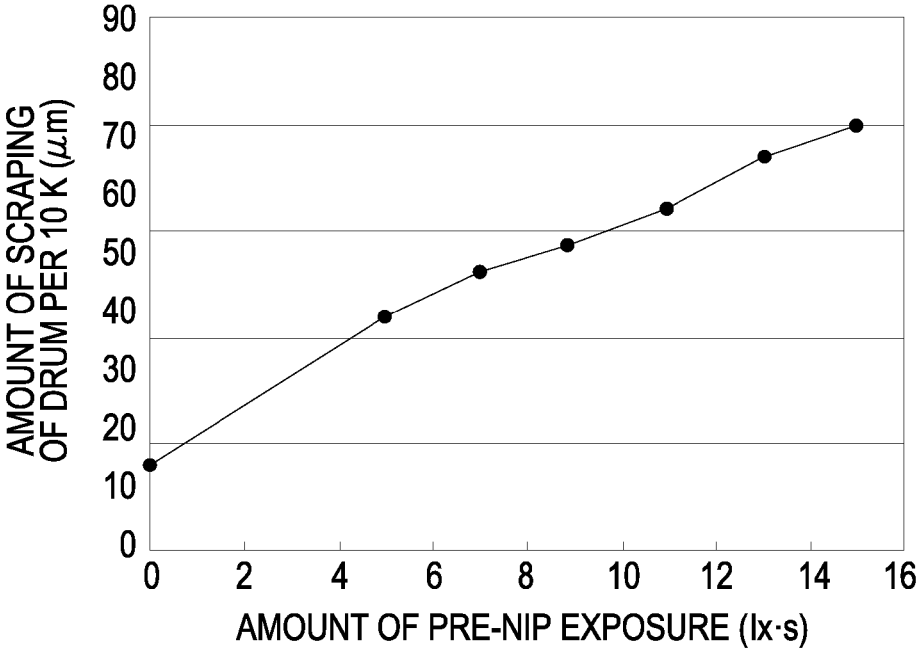
FIG. 4B is a graph illustrating the relationship between the value of the current and the amount of scraping of the photoconductor drum.

The amount of pre-nip exposure and the amount of scraping of the photoconductor drum 1 will be described hereinafter. FIG. 4A is a graph illustrating the relationship between the amount of pre-nip exposure and a direct-current current flowing between the photoconductor drum 1 and the charging roller 2. Further, FIG. 4B is a graph illustrating the relationship between a direct-current current flowing between the photoconductor drum 1 and the charging roller 2 and the amount of scraping of the photoconductor drum 1 when 10,000 (10K) A4 size sheets having solid white images (0 in 255 grayscale levels) over the entirety thereof are output. Specifically, in FIGS. 4A and 4B, the process speed is 210 mm/s, the charging potential is −500 V, solid-white printing endurance is measured, and the DC current value is measured using an ammeter provided between the photoconductor drum 1 and a ground.

As can be seen from FIGS. 4A and 4B, as the amount of light radiated to the charging gap (hereinafter referred to as the amount of pre-nip exposure) increases, the amount of scraping of the photoconductor drum 1 increases. This is because as the amount of pre-nip exposure increases, the amount of erasure in the upstream charging gap between the photoconductor drum 1 and the charging roller 2 increases, resulting in an increase in redischarging for recharging the photoconductor drum 1 from the charging roller 2. Thus, for a high process speed (210 mm/s), irradiation with light at a light amount (15 lx·s), which is required to suppress formation of a charging lateral stripe on the photoconductor drum 1 for a low process speed (105 mm/s), reduces the life of the photoconductor drum 1. Therefore, it is preferable that pre-nip exposure be performed with the amount of light corresponding to the process speed in order to prolong the life of the photoconductor drum 1 while suppressing formation of a charging lateral stripe.

{Description of Operation of Image Forming Apparatus Using Flowchart}

Figure 5:
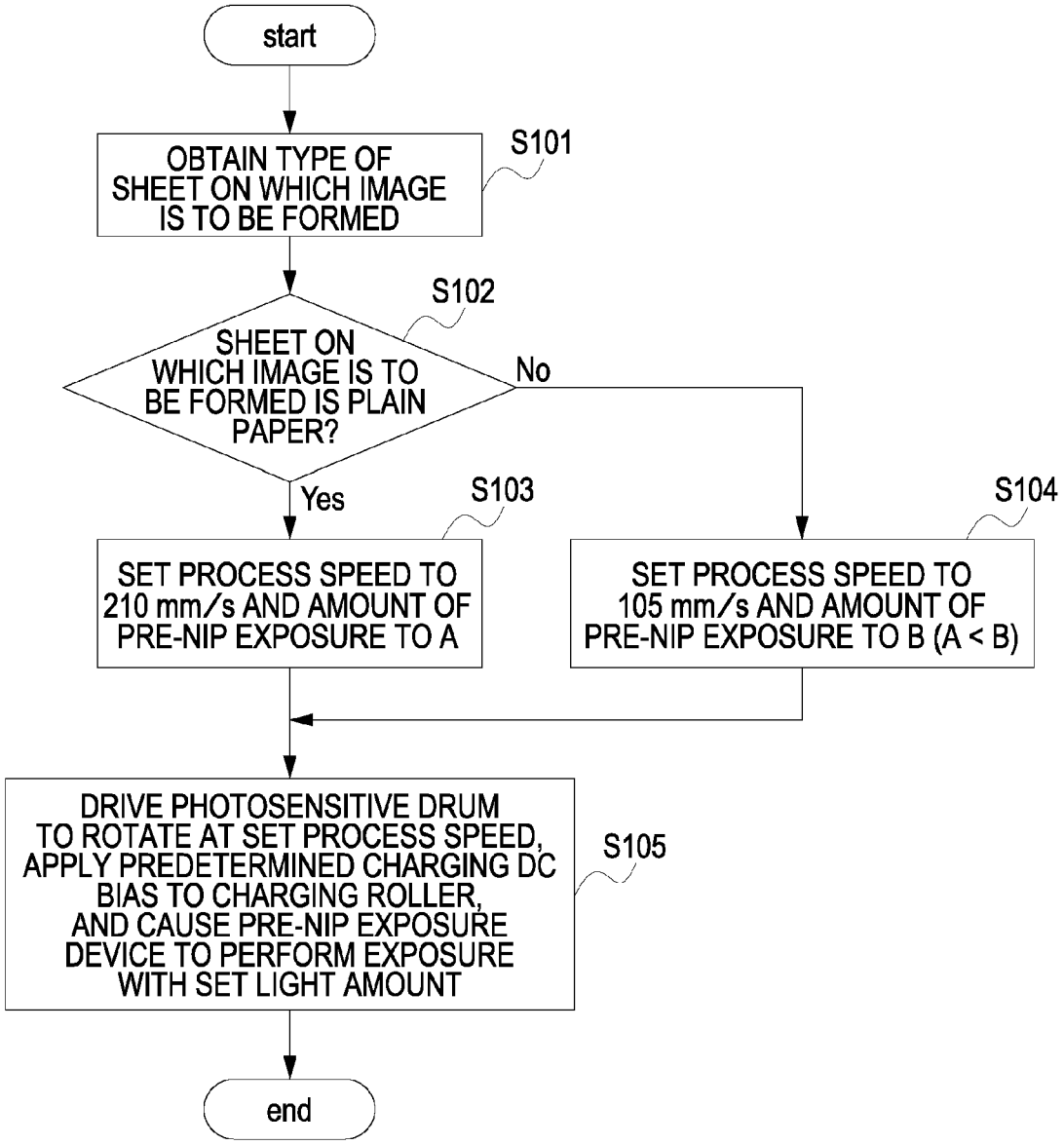
FIG. 5 is a flowchart describing the operation of the image forming apparatus.

The operation of the image forming apparatus for changing the amount of pre-nip exposure in accordance with the process speed will be described hereinafter with reference to a flowchart. FIG. 5 is a flowchart describing the operation of the image forming apparatus. The CPU in the control circuit controls the image forming apparatus in accordance with a program stored in the ROM to operate in the manner as in the flowchart described in FIG. 5. The description will be given of an example in which image forming conditions are changed in accordance with the type of a sheet on which an image is to be formed. It is assumed that a user has specified the type of a sheet on which an image is to be formed using the operation panel.

S101 is a step in which the control circuit 200 serving as a control device obtains the type of a sheet on which an image is to be formed. The control circuit 200 obtains the type of the sheet set on the operation panel 100. S102 is a step for changing the process in accordance with the type of the sheet on which an image is to be formed. When the type of the sheet on which an image is to be formed, which is obtained in S101, is plain paper, the control circuit 200 executes the processing of S103. Further, when the type of the sheet on which an image is to be formed, which is obtained in S101, is thick paper, the control circuit 200 executes the processing of S104.

S103 is a step for setting image forming conditions when an image is to be formed on plain paper. The control circuit 200 sets the process speed for which an image is to be formed on plain paper to 210 mm/s and the amount of pre-nip exposure to 7 lx·s (first light amount). S104 is a step for setting image forming conditions when an image is to be formed on thick paper. The control circuit 200 sets the process speed for which an image is to be formed on thick paper to 105 mm/s and the amount of pre-nip exposure to 15 lx·s (second light amount). In S105, the control circuit 200 controls the image forming apparatus in accordance with the image forming conditions set in S103 or S104. Specifically, during image formation in which an image is formed on a sheet, the control circuit 200 drives the photoconductor drum 1 and the like to rotate to achieve the set process speed. Further, control is performed so that the pre-nip exposure device 8 can perform exposure at the desired amount of light to apply the desired charge bias to the charging roller 2.

In this manner, prior to image formation, the control circuit 200 changes the amount of pre-nip exposure in accordance with the process speed. That is, as described above, a configuration is provided so that when the process speed is low, the amount of pre-nip exposure can be made large. With this configuration, the occurrence of a charging lateral stripe, which occurs when the photoconductor drum 1 is charged by the charging roller 2, is suppressed. That is, even when the process speed is changed depending on the type of the sheet on which an image is to be formed, the occurrence of an image defect caused by a charging lateral stripe can be suppressed. It is preferable that pre-nip exposure be performed when a portion of the photoconductor drum on which an electrostatic image corresponding to an image to be formed on a sheet is to be formed is charged.

In an example, changing the power to be supplied to the pre-nip exposure device 8 from the power source S4 changes the amount of light radiated to the upstream-side charging gap by the pre-nip exposure device 8. However, changing the distance between the pre-nip exposure device and the upstream-side charging gap also may change the amount of light radiated to the upstream-side charging gap. That is, when the process speed is low, bringing the pre-nip exposure device 8 in closer proximity to the upstream-side charging gap than that when the process speed is high may increase the amount of light radiated to the upstream-side charging gap. Further, a deflecting plate capable of adjusting light radiated to the upstream-side charging gap by the pre-nip exposure device 8 also may be provided.

Example 2

Substantially the same portions as those in example 1 are assigned the same numerals and the descriptions thereof are thus omitted. In the example, the amount of light radiated to the upstream-side charging gap is adjusted using a reflecting mirror serving as a reflecting member. Since exposure of the upstream-side charging gap to light is performed using the reflecting mirror, the reflecting mirror also corresponds to an irradiation device. In the example, a configuration is adopted in which a light source of pre-exposure for removing residual electric charge that remains on the photoconductor drum after transfer and a light source of pre-nip exposure for suppressing the occurrence of a charging lateral stripe are commonly used. It is to be understood that a light source for removing residual electric charge on the photoconductor drum and a light source of pre-nip exposure may be provided separately. In this case, the light source for removing residual electric charge on the photoconductor drum corresponds to an erasing device. Here, it is preferable that the higher the process speed of the photoconductor drum 1, the larger the amount of light radiated in order to erase residual electric charge on the photoconductor drum after transfer. Conversely, it is preferable that the higher the process speed, the smaller the amount of light required for the charging nip. Thus, in the example, light from a single light source is distributed to an upstream-side charging gap and a pre-exposure unit to remove residual electric charge and suppress the occurrence of a charging lateral stripe. A configuration for removing residual electric charge and suppressing formation of a charging lateral stripe will be described hereinafter.

{Regarding Configuration of Pre-Nip Exposure Using Reflecting Mirror}

Figure 6:
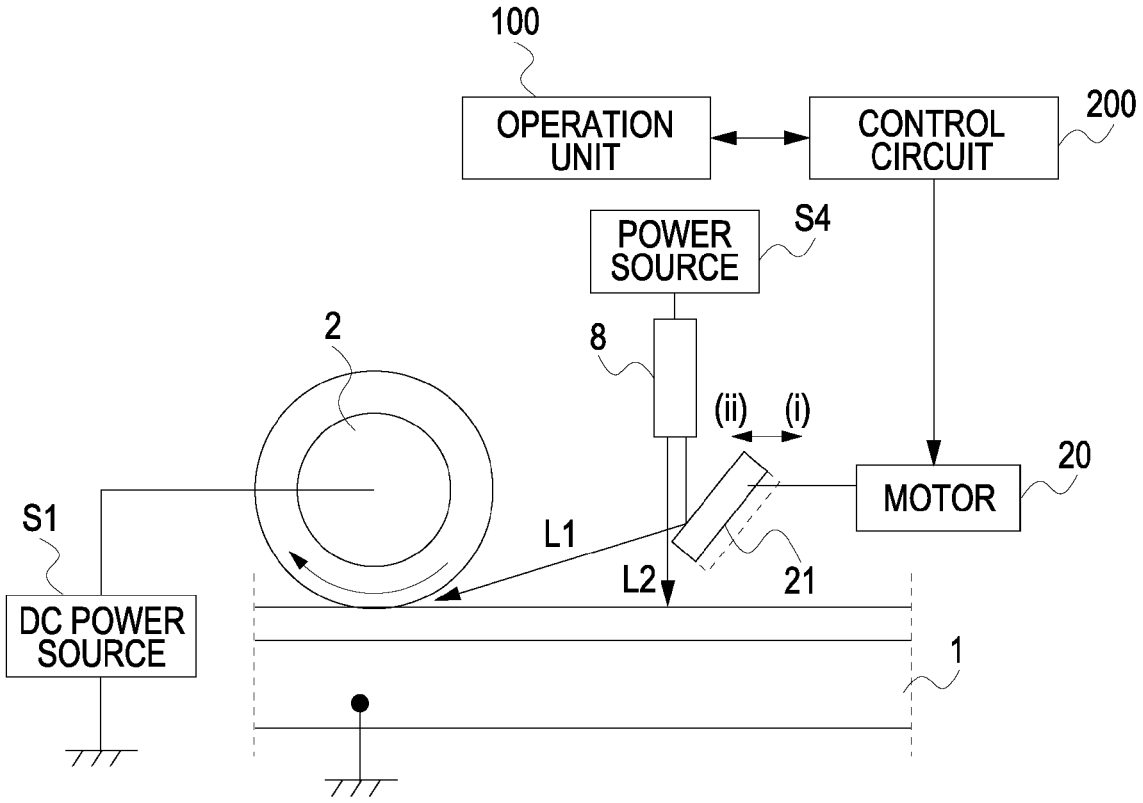
FIG. 6 is a block diagram of the image forming apparatus.

In the example, a pre-nip exposure device that emits light at a constant light amount and a reflecting mirror, whose position is finely adjusted by a motor, are used to remove residual electric charge on the photoconductor drum and to suppress formation of a charging lateral stripe. FIG. 6 is a diagram describing the configuration of an apparatus that exposes a charging gap and a pre-exposure unit to light. In the example, a power source S4 supplies constant power to a pre-nip exposure device 8. Thus, the pre-nip exposure device 8 continues to output light at a constant light amount. The pre-nip exposure device 8 serving as a light source is provided to face the surface of the photoconductor drum 1, and a reflecting mirror 21 serving as an irradiation device is disposed between the pre-nip exposure device 8 and the photoconductor drum 1.

A motor finely adjusts the position of the reflecting mirror 21 serving as an irradiation device. The reflecting mirror 21 reflects a laser beam L output from the pre-nip exposure device 8, thereby directing the laser beam L1 to an upstream-side charging gap. A laser beam L2 that is not reflected by the reflecting mirror 21 is radiated to the photoconductor drum 1. Therefore, electric charge (residual electric charge) that remains on the photoconductor drum after a toner image formed on the photoconductor drum 1 is transferred can be erased. The laser beam L2 reflected by the reflecting mirror 21 erases an image forming region in the longitudinal direction of the photoconductor drum 1. Here, the power source S4 supplies power so that the pre-nip exposure device 8 can emit light at 20 lx·s. Further, a motor 20 finely adjusts the position of the reflecting mirror 21. When the reflecting mirror 21 is located at a position (i), the laser beam L1 is 7 lx·s (first light amount) and the laser beam L2 is 13 lx·s (third light amount). Further, when the reflecting mirror 21 is located at a position (ii), the laser beam L1 is 15 lx·s (second light amount) and the laser beam L2 is 5 lx·s (fourth light amount).

A pre-exposure device serving as a removing device for removing residual electric charge may be provided separately from an inter-nip exposure device. In this case, a control circuit serving as a control device performs control so that the pre-exposure device can remove residual electric charge on the photoconductor drum at 13 lx·s (third light amount) when the process speed is 210 mm/s. Further, the control circuit performs control so that the pre-exposure device can remove residual electric charge on the photoconductor drum at 5 lx·s (fourth light amount) when the process speed is 105 mm/s.

That is, in either case, the laser beam L2 serving to erase residual electric charge is radiated to the photoconductor drum 1. Thus, after a developing device develops an electrostatic image formed on the photoconductor drum 1 and a toner image is transferred onto a sheet serving as a transfer target member, residual electric charge on the photoconductor drum 1 can be removed. Exposure to the laser beam L2 serving to remove the residual electric charge is performed for a period from when the toner image is transferred onto the sheet at the transfer portion to when the toner image is conveyed to the upstream-side gap portion. Similar to Example 1, a control circuit 200 includes a CPU, a RAM, etc., and controls individual units of the image forming apparatus in accordance with an image forming signal input from an operation panel 100 serving as an operation unit or an external terminal such as a PC. The motor 20 can cause the reflecting mirror 21 to move to the position (i) or (ii) in accordance with the input from the control circuit 200.

{Description of Operation of Image Forming Apparatus Using Flowchart}

Figure 7:
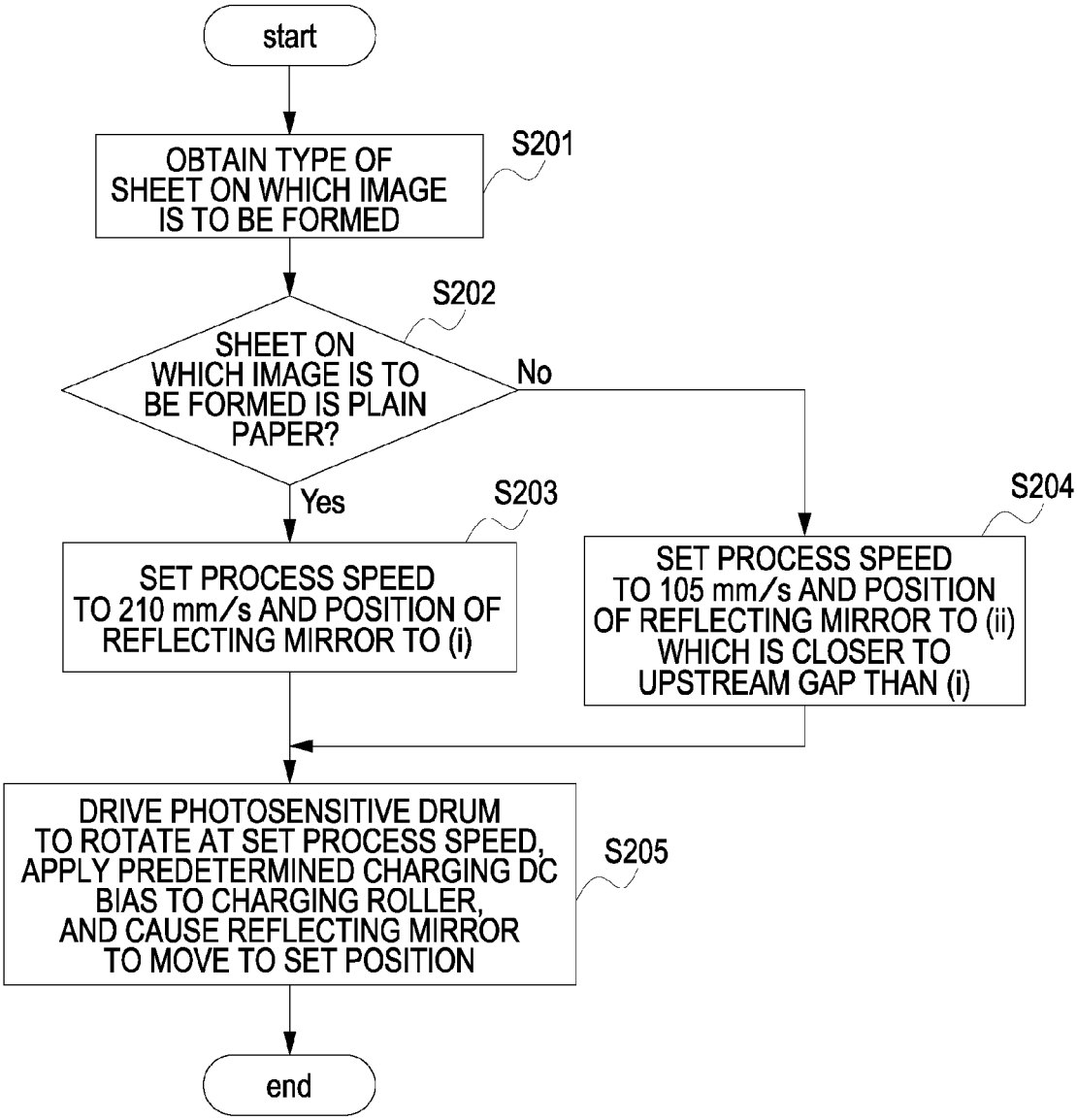
FIG. 7 is a flowchart describing the operation of the image forming apparatus.

The operation of the image forming apparatus for adjusting the amount of light radiated to the upstream-side charging gap and the amount of light with which pre-exposure is performed to remove residual electric charge on the photoconductor drum in accordance with the process speed will be described with reference to a flowchart. FIG. 7 is a flowchart illustrating the operation of the image forming apparatus example. In the example, the description will be given of an example in which image forming conditions are changed in accordance with the type of a sheet on which an image is to be formed.

S201 is a step in which the control circuit 200 serving as a control device obtains the type of a sheet on which an image is to be formed. The control circuit 200 obtains the type of the sheet set on the operation panel 100. S202 is a step for changing the process in accordance with the type of the sheet on which an image is to be formed. When the type of the sheet on which an image is to be formed, which is obtained in S201, is plain paper, the control circuit 200 executes the processing of S203. Further, when the type of the sheet on which an image is to be formed, which is obtained in S201, is thick paper, the control circuit 200 executes the processing of S204.

S203 is a step for setting image forming conditions when an image is to be formed on plain paper. The control circuit 200 sets the process speed for which an image is to be formed on plain paper to 210 mm/s and the position of the reflecting mirror 21 to (i). S204 is a step for setting image forming conditions when an image is to be formed on thick paper. The control circuit 200 sets the process speed for which an image is to be formed on thick paper to 105 mm/s and the position of the reflecting mirror 21 to (ii). In S205, the control circuit 200 controls the image forming apparatus in accordance with the image forming conditions set in S203 or S204. Specifically, the control circuit 200 drives the photoconductor drum 1 and the like to rotate to achieve the set process speed. Further, the motor 20 is controlled so that the reflecting mirror 21 can be located at the desired position to apply the desired charge bias to the charging roller 2.

In this manner, prior to image formation, the control circuit 200 changes the position of the reflecting mirror 21 in accordance with the process speed. That is, a configuration is provided so that when the process speed is low, the amount of pre-nip exposure can be large and the amount of pre-exposure can be small. This configuration can remove residual electric charge on the photoconductor drum 1 while suppressing the occurrence of a charging lateral stripe, which occurs when the charging roller 2 charges the photoconductor drum 1. That is, even when the process speed is changed depending on the type of the sheet on which an image is to be formed, light sources can be commonly used while the occurrence of an image defect caused by a charging lateral stripe is suppressed.

{Regarding Other Configuration}

In the example, adjusting the position of the reflecting mirror 21 achieves the erasure of residual electric charge and the suppression of occurrence of a charging lateral stripe. However, a half-mirror type variable transmittance element (a mirror whose reflectance and transmittance are changed by applying a voltage) serving as a reflecting member capable of adjusting the amount of reflection and the amount of transmission of light may be used. With the use of a half-mirror type variable transmittance element in place of the reflecting mirror 21, it is not necessary to move the reflecting mirror 21. Thus, an upstream-side charging gap can be exposed to light at a higher accuracy than that when a mirror is moved using a motor.

Further, in example 1 and example 2, the description has been given in the context of, by way of example, two types of sheets on which an image is to be formed, that is, plain paper and thick paper. However, it is to be understood that there may occur similar problems with other types of paper (coated paper, thin paper), other media (OHT), and the like as long as the process speed is changed. Note that an image forming apparatus forms an image at a process speed determined in advance in accordance with the type of sheet. Further, while in the foregoing examples, LEDs are adopted as a pre-nip exposure device and a pre-exposure device, other exposure devices such as a light irradiation device including a fuse lamp also may be used. Further, an upstream-side charging gap may be exposed to light from inside a transparent photosensitive member.

In example 1 and example 2, the description has been given of the charging roller 2 serving as a flexible contact charging member, by way of example. However, similar benefits can be expected, as long as the distance of the upstream-side charging gap decreases and the distance of the downstream-side charging gap increases, regardless of whether the distance between the charging member and the photosensitive member increases linearly or non-linearly. For example, a conductive charging belt, a conductive rubber blade that is brought into abutment against the photosensitive member at the edge portions to charge the photosensitive member, or the like may be used as a charging member. While in the examples, the charging roller 2 serving as a charging member and the photoconductor drum 1 serving as a photosensitive member are in contact with each other, a small gap may be formed. In this configuration, the distance between the photoconductor drum 1 and the charging roller 2 decreases toward the position where the charging roller 2 and the photoconductor drum 1 are the closest to each other in the rotation direction of the photoconductor drum 1.

In the examples, the rotatable drum-shaped photoconductor drum 1 is used. However, a movable belt-shaped photosensitive belt may be used as a photosensitive member. In this case, it is assumed that the upstream and downstream in the rotation direction of the photoconductor drum 1 correspond to the upstream and downstream in the movement direction of the photosensitive belt, respectively.

Furthermore, while a photosensitive member longitudinal image region in an upstream-side charging gap between the photoconductor drum 1 and the charging roller 2 is exposed to light in order to suppress formation of a charging lateral stripe that appears on an image, an entire longitudinal area of the photoconductor drum 1 may be exposed to light. This can suppress the occurrence of non-uniformity in the amount of scraping in the longitudinal direction of the photoconductor drum 1 when an apparatus that forms an image on a small sheet and a large sheet continues to form an image on small paper. In addition, a media sensor may be used to specify a sheet on which an image is to be formed. In addition, an image forming apparatus having the so-called cleanerless configuration in which developing and cleaning are simultaneously performed using a developing device also can be used.

In an image forming apparatus in which applying a direct-current voltage to a charging member charges a photosensitive member, the occurrence of a charging lateral stripe can be suppressed even when the rotational speed of the photosensitive member is changed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of International Application No. PCT/JP2009/065809, filed Sep. 10, 2009, which is hereby incorporated by reference herein in its entirety.

What is claimed is:

1. An image forming apparatus, comprising:

a rotatable photosensitive member;

a charging member configured to be in contact with the photosensitive member to charge the photosensitive member;

an applying device configured to apply a direct-current voltage to the charging member;

an irradiation device configured to irradiate with light an upstream charging gap located upstream of a contact portion between the photosensitive member and the charging member in a rotation direction of the photosensitive member; and a controller for controlling the irradiation device to irradiate with a first light amount when the photosensitive member rotates at a first speed, and to irradiate with a second light amount that is larger than the first light amount when the photosensitive member rotates at a second speed that is lower than the first speed.

2. The image forming apparatus according to claim 1, further comprising:

an electrostatic image forming device configured to form an electrostatic image on the photosensitive member charged by the charging member;

a developing device configured to use toner to develop the electrostatic image formed on the photosensitive member to create a toner image;

a transfer member configured to transfer the toner image onto a transfer target member; and a removing device configured to remove electric charge by irradiating a surface of the photosensitive member with removing light for a period that begins when the toner image is transferred onto the transfer target member and ends when the toner image is moved to the upstream gap, wherein the controller controls the removing device to irradiate the surface of the photosensitive member with a third light amount when the photosensitive member rotates at the first speed, and to irradiate the surface of the photosensitive member with a fourth light amount that is smaller than the third light amount when the photosensitive member rotates at the second speed.

* * * * *